US006742450B2

(12) United States Patent
Mori

(10) Patent No.: US 6,742,450 B2
(45) Date of Patent: Jun. 1, 2004

(54) STENCIL PRINTER AND METHOD AND DEVICE FOR MAKING A MASTER THEREFOR

(75) Inventor: Tomiya Mori, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 10 days.

(21) Appl. No.: 10/205,402

(22) Filed: Jul. 26, 2002

(65) Prior Publication Data

US 2003/0019372 A1 Jan. 30, 2003

(30) Foreign Application Priority Data

Jul. 27, 2001 (JP) ..... 2001-227701
Apr. 3, 2002 (JP) ..... 2002-101493

(51) Int. Cl.[7] ..... B41C 1/14

(52) U.S. Cl. ..... 101/128.4; 101/116; 101/120; 101/128

(58) Field of Search ..... 101/128.4, 116, 101/128, 120

(56) References Cited

U.S. PATENT DOCUMENTS 4,628,813 A * 12/1986 Hasegawa et al. ..... 101/116
5,224,419 A * 7/1993 Fukai ..... 101/128.4
5,640,904 A * 6/1997 Sato et al. ..... 101/128.4
5,740,731 A * 4/1998 Kagawa ..... 101/128.4
5,970,869 A * 10/1999 Hara et al. ..... 101/128.4
5,988,061 A * 11/1999 Kagawa ..... 101/128.4
6,076,460 A * 6/2000 Kagawa ..... 101/128.4
6,393,979 B1 * 5/2002 Tateishi ..... 101/128.21

FOREIGN PATENT DOCUMENTS

JP 6-270527 9/1994
JP 10-236011 9/1998

* cited by examiner

*Primary Examiner*—Andrew H. Hirshfeld
*Assistant Examiner*—Marissa Ferguson
(74) *Attorney, Agent, or Firm*—Oblon, Spivak, McClelland, Maier & Neustadt, P.C.

(57) ABSTRACT

A stencil printer of the present invention includes a master making section for perforating a master, which includes a porous support and a thermoplastic resin film, in accordance with image data to thereby make a master and wraps the master around a print drum to thereby effect printing. The stencil printer includes a cavity sensor for sensing the condition of cavities existing in the porous support of the stencil. A controller identifies the kind of the stencil by determining the condition of the cavities in accordance with information output from the cavity sensor, so that stable print quality is insured without regard to a difference in cavity ratio between the lots of stencils.

21 Claims, 7 Drawing Sheets

STENCIL PRINTER AND METHOD AND DEVICE FOR MAKING A MASTER THEREFOR

BACKGROUND OF THE INVENTION

1. Field of the Invention

The present invention relates to a stencil printer for effecting printing with a master wrapped around a print drum and more particularly to a method and a device for making the master.

2. Description of the Background Art

A digital, thermosensitive stencil printing system is conventional as a simple printing system. In this simple printing system, a thermal head or similar perforating means perforates a thermosensitive stencil by melting it with heat to thereby make a master. The master is wrapped around a porous, hollow cylindrical print drum. Ink feeding means disposed in the print drum feeds ink to the inner periphery of the print drum while a press roller or similar pressing means presses a sheet or recording medium against the print drum. As a result, the ink is transferred from the print drum to the sheet via the perforation pattern of the master, forming an ink image on the sheet.

A stencil is usually implemented as a laminate made up of a thermosensitive resin film (simply film hereinafter) and an ink-permeable support adhered to the film and implemented as a porous fiber film (usual stencil hereinafter). The porous fiber film is generally formed of flax fibers or a mixture of flax fibers, synthetic fibers and wood fibers. A problem with the usual master is that because the porous fiber support exists just on the film, a great amount of adhesive gathers in the form of webs at positions where fibers overlapping each other and the film contact each other. At such positions, it is difficult for the thermal head to perforate, or cut, the stencil, making the resulting print irregular.

In light of the above, Japanese Patent Laid-Open Publication No. 10-236011 discloses a thermosensitive stencil implemented as a laminate made up of a thermoplastic resin film, a porous resin film formed on one surface of the film, and a porous fiber film formed on the porous resin film and formed of interconnected fibers. The porous resin film refers to a porous film formed by precipitating resin dissolved in a solvent and then solidifying it by way of example. In the porous resin film, fine cavities overlap each other in a complicated structure in the direction of thickness of film. Also, the porous fiber film refers to a film implemented as, e.g., a thin sheet of cotton, flax or similar plant fibers or polyester, polyvinyl alcohol or similar synthetic fibers; the fibers are adhered together and interconnected by intertwining or weaving. With such a configuration, the stencil obviates irregular printing stated above and attains enhanced elasticity and tensile strength, thereby improving image quality.

A master making condition (e.g. perforation energy) and a printing condition (e.g. the kind of ink matching ink-permeability) noticeably differ from the usual stencil to the stencil including the porous resin film stated above. Therefore, when printing is effected with the usual stencil in a condition matching with the stencil including the porous resin film, the resulting print is defective. This is also true when printing effected with the stencil including the porous resin film in a condition matching with the usual stencil.

It is difficult for the operator of the printer to distinguish the kind of the stencil, i.e., the usual stencil and the stencil including the porous resin film by eye. The operator therefore cannot see the setting of an unqualified stencil until at least one print has been produced. In such a case, the operator has to discard or replace a master or set a qualified stencil, resulting in troublesome operation, wasteful stencil consumption, and noticeable down time.

Moreover, even identical stencils including the porous resin film each are different in cavity ratio, i.e., the density of cavities in the porous resin film, depending on the lot. Consequently, the stencils are different in ink permeability, obstructing stable image quality.

Technologies relating to the present invention are also disclosed in, e.g., Japanese Patent Laid-Open Publication Nos. 6-270527 and 10-236011.

SUMMARY OF THE INVENTION

It is an object of the present invention to provide a master making method capable of automatically detecting an unqualified stencil before master making to thereby allow it to be replaced or allow settings to be varied and reduce the down time, a mater making device for practicing it, and a stencil printer including the same.

It is another object of the present invention to provide a master making method capable of insuring stable print quality without regard to irregularity in the cavity ratio of a porous resin film, a master making device for practicing it, and a stencil printer including the same.

In accordance with the present invention, a master making device for a stencil printer includes a master making section for perforating a stencil, which includes a support formed on one of opposite surfaces of a thermoplastic resin film, in accordance with image data. A transmission type sensor senses the transmittance of the stencil in a direction of thickness. A controller determines the condition of cavities existing in the stencil in accordance with information output from the sensor and then varies a master making condition in matching relation to the condition. Alternatively, the controller may inhibit master making operation if the stencil is an unqualified stencil.

Also, in accordance with the present invention, a master making device for a stencil printer includes a master making device for perforating a stencil, which includes a support formed on one of opposite surfaces of a thermoplastic resin film, in accordance with image data. A reflection type sensor faces one of opposite surfaces of the stencil. A low-reflectance member faces the reflection type sensor with the intermediary the stencil. A controller determines a condition of cavities existing in the support of the stencil in accordance with information output from the reflection type sensor and then varies a master making condition in matching relation to the condition. Alternatively, the controller may inhibit master making operation if the stencil is an unqualified stencil.

A master making device and a stencil printer including any one of the master making devices described above are also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

First Embodiment

Figure 1:
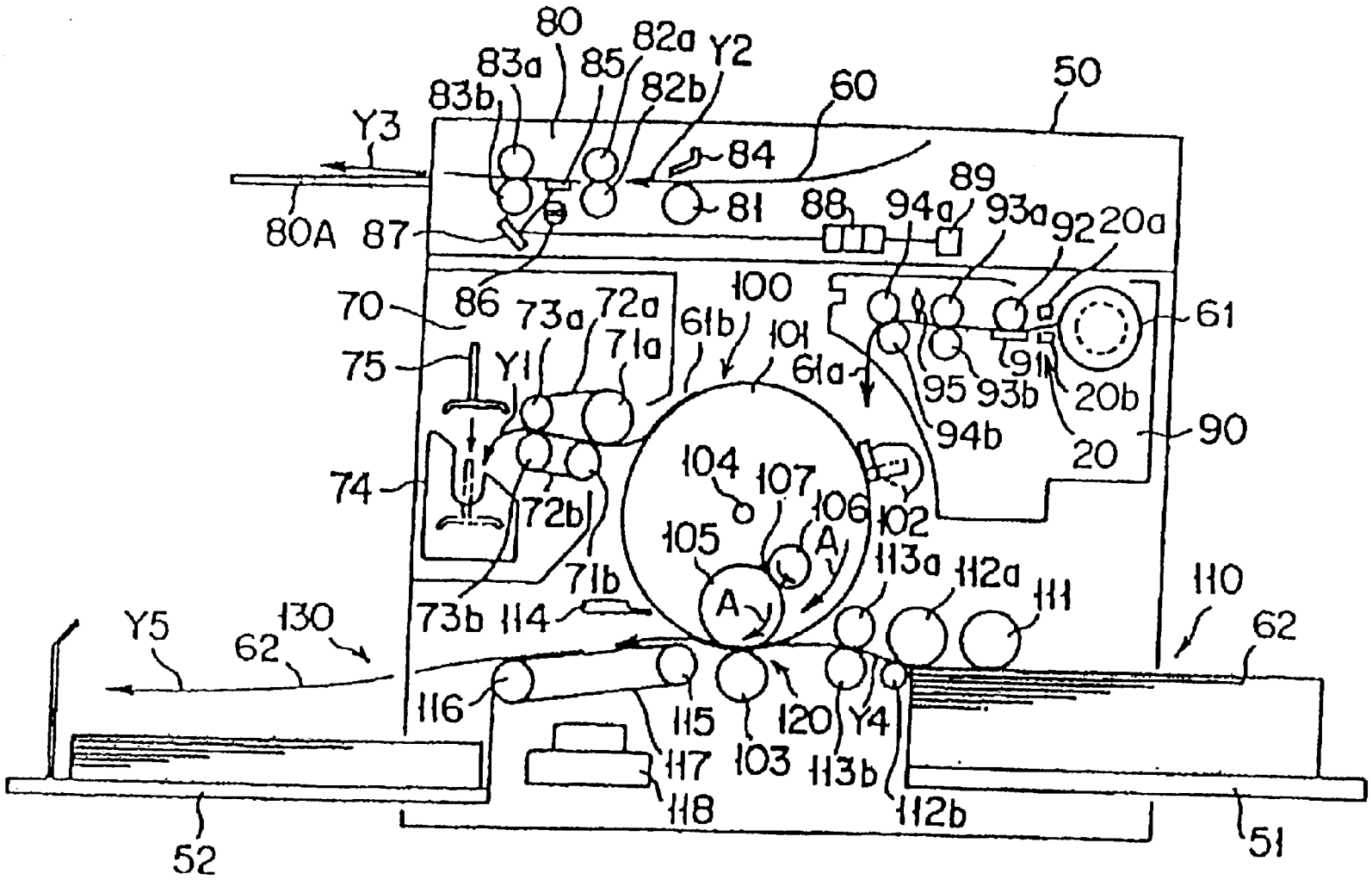
FIG. 1 is a front view showing the general construction of a stencil printer in accordance with the present invention.

Referring to FIG. 1 of the drawings, a first embodiment of the stencil printer in accordance with the present invention will be described. As shown, the stencil printer includes a printer body 50. An image scanning section 80 is arranged in the upper portion of the printer body 50. A drum section 100 including a porous print drum 101 is disposed below the image scanning section 80 at the center portion of the printer body 50. A master making device 90 is arranged above and at the right-hand side of the drum section 100. A master discharging section 70 is positioned above and at the left-hand side of the drum section 100. A sheet feeding section 110 is positioned below the master making device 90. A pressing section 120 is positioned below the drum section 100 while a print discharging section 130 is positioned below the master discharging section 70.

In operation, the operator of the printer sets a desired document 60 on a document tray, not shown, positioned on the top of the image scanning section 80. The operator then presses a perforation start key provided on a control panel although not shown specifically. In response, the printer executes a master discharging step. More specifically, at the time when the perforation start key is pressed, a used master 61*b*, which is a perforated or cut thermosensitive stencil, is still left on the print drum 101. In the master discharging step, the print drum 101 is rotated counterclockwise, as viewed in FIG. 1. When the tailing edge of the used master 61*b* approaches a pair of peel rollers 71*a* and 71*b* in rotation, the peel roller 71*a* picks up the used master 61*b*.

An endless belt 72*a* is passed over the peel roller 71*a* and a roller 73*a* positioned at the left-hand side of the peel roller 71*a*. Likewise, an endless belt 72*b* is passed over the peel roller 71*b* and a roller 73*b* positioned at the left-hand side of the peel roller 71*b*. The belts 72*a* and 72*b* cooperate to convey the used master 61*b* in a direction indicated by an arrow Y1 in FIG. 1 and discharge it into a waste master box 74. At this instant, the print drum 101 is continuously rotated counterclockwise. A presser plate 75 is lowered into the waste master box 74 to compress it within the box 74.

The image scanning section 80 reads the document 60 in parallel with the master discharging step. More specifically, a pickup roller 81 pays out the document 60 from the document tray. An upstream pair of rollers 82*a* and 82*b* and a downstream pair of rollers 83*a* and 83*b* in rotation sequentially convey the document 60 picked up in directions Y2 and Y3. When a plurality of documents 60 are stacked on the document tray, a separator blade 84 causes only the lowermost document to be paid out. When the document 60 is conveyed by the above roller pairs along a glass platen, a fluorescent lamp or light source 86 illuminates the document. The resulting imagewise reflection from the document 60 is reflected by a mirror 87 and then incident to a CCD (Charge Coupled Device) image sensor 89 via a lens 88. In this manner, the document 60 is read by a conventional reduction type scanning system.

The document 60 scanned by the image scanning section 80 is driven out of the printer body 50 to a tray 80A. An analog signal output from the CCD image sensor 89 is sent to an AD (Analog-to-Digital) converter, not shown, built in the printer body 50 and converted to a digital image signal thereby.

A master making step based on the above digital image data and a master feeding step are executed in parallel with the document scanning step. More specifically, a thermosensitive stencil 61 is paid out from a stencil roll set at a preselected position in the master making device 90. A platen roller 92 is pressed against a thermal head 91 via the stencil 61 paid out from the roll. The platen roller 92 and a pair of tension rollers 93*a* and 93*b*, which are in rotation, drive the stencil 61 to the downstream side in the direction of stencil feed.

The thermal head 91 includes a number of fine heat generating elements, not shown, arranged in an array. The heat generating elements are selectively caused to generate heat in accordance with the digital image signal, thereby selectively perforating or cutting a thermoplastic resin film, which will be described later, included in the stencil 61 with heat. As a result, the image data are written in the stencil 61 in the form of a perforation pattern.

A transmission type sensing means 20 is positioned upstream of the thermal head 91 in the direction of stencil feed for sensing the transmittance of the stencil 61, e.g., the quantity of light transmitted through the stencil 61. The sensing means 20 is made up of a light emitting device 20*b* and a transmission type photosensor 20*a*.

A pair of stencil feed rollers 94*a* and 94*b* convey the leading edge of the perforated stencil, labeled 61*a*, toward the circumference of the print drum 101. A guide member, not shown, steers the leading edge of the stencil 61*a* downward with the result that the stencil 61*a* hangs down toward a master damper 102 (indicated by a phantom line) positioned on the print drum 101. At this instant, the master damper 102 is held open at a master feed position. The used master 61*b* has already been removed from the print drum 101 by the previously stated master discharging step.

As soon as the master damper 102 clamps the leading edge of the stencil 61*a* at a preselected timing, the print drum 101 is rotated clockwise (indicated by an arrow A) so as to wrap the stencil 61*a* therearound little by little. A cutter 95 cuts the trailing edge of the perforated stencil 61*a* at a preselected length.

When the perforated stencil 61*a* (master 61*a* hereinafter) cut by the cutter 95 is wrapped around the print drum 101, the master making step and master feeding step end and are followed by a printing step. In the printing step, a pickup roller 111 and a pair of reverse rollers 112*a* and 112*b* cooperate to pay out the uppermost one of sheets 62 stacked on a sheet tray 51 toward a pair of feed rollers 113*a* and 113*b* in a direction Y4. The feed rollers 113*a* and 113*b* convey the sheet 62 toward the pressing section 120 at a preselected timing synchronous to the rotation of the print drum 101. When the sheet 62 arrives at a nip between the print drum 101 and the press roller 103, a press roller 103, which is usually released from the print drum 101, moves upward and presses the sheet 62 against the master 61*a* wrapped around the print drum 101. Consequently, ink is transferred to the sheet 62 via the porous portion of the print drum 101 and the perforation pattern, not shown, of the master 61*a*, forming an ink image on the sheet.

More specifically, an ink feed pipe 104 disposed in the print drum 101 feeds ink to an ink well 107 formed between an ink roller 105 and a doctor roller 106. The ink roller 105 is pressed against the inner periphery of the print drum 101 and rotated in the same direction as the print drum 101 in synchronism with the rotation speed of the print drum 101. The ink roller 105 therefore feeds the ink to the inner periphery of the print drum 101.

A peeler 114 peels off the sheet 62 carrying the image and coming out of the pressing section 120 from the print drum 101. An endless belt 117 is passed over an inlet roller 115 and an outlet roller 116 and rotated counterclockwise to convey the sheet, or print, 62 toward the print discharging section 130 in a direction Y5. At this instant, a suction fan 118 sucks the print 62 to thereby retain it on the belt 117. Finally, the print 62 is driven out to a print tray 52 as a so-called trial print.

If the trial print is acceptable, then the operator sets a desired number of prints on numeral keys, not shown, and then presses a print start key not shown. In response, the printer repeats the sheet feeding step, printing step and print discharging step described above a number of times corresponding to the desired number of prints.

Figure 2:
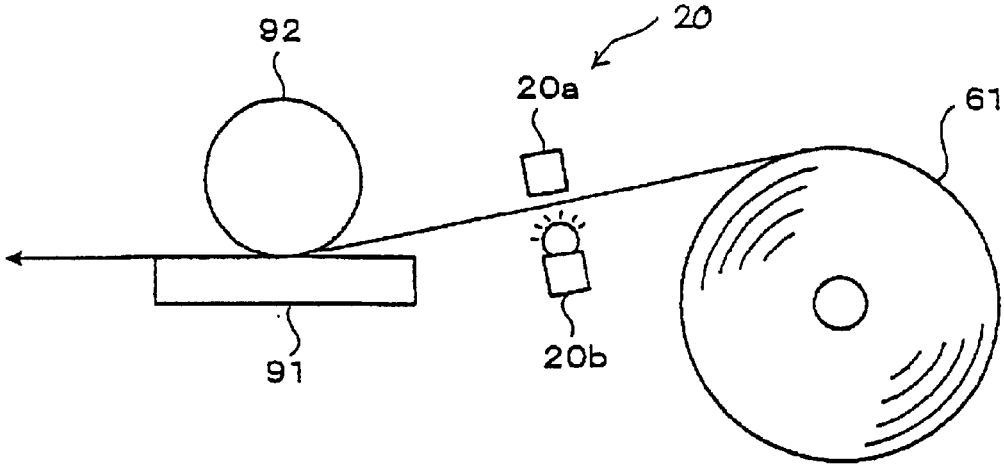
FIG. 2 is a fragmentary view showing a master making device included in a first embodiment of the present invention.

FIG. 2 shows the transmission type sensing means 20 in detail. As shown, the light emitting element 20*b* is implemented by an LED (Light Emitting Diode) by way of example. The light emitting element 20*b* and transmission type photosensor 20*a* face each other with the intermediary of the stencil 61.

Figure 3:
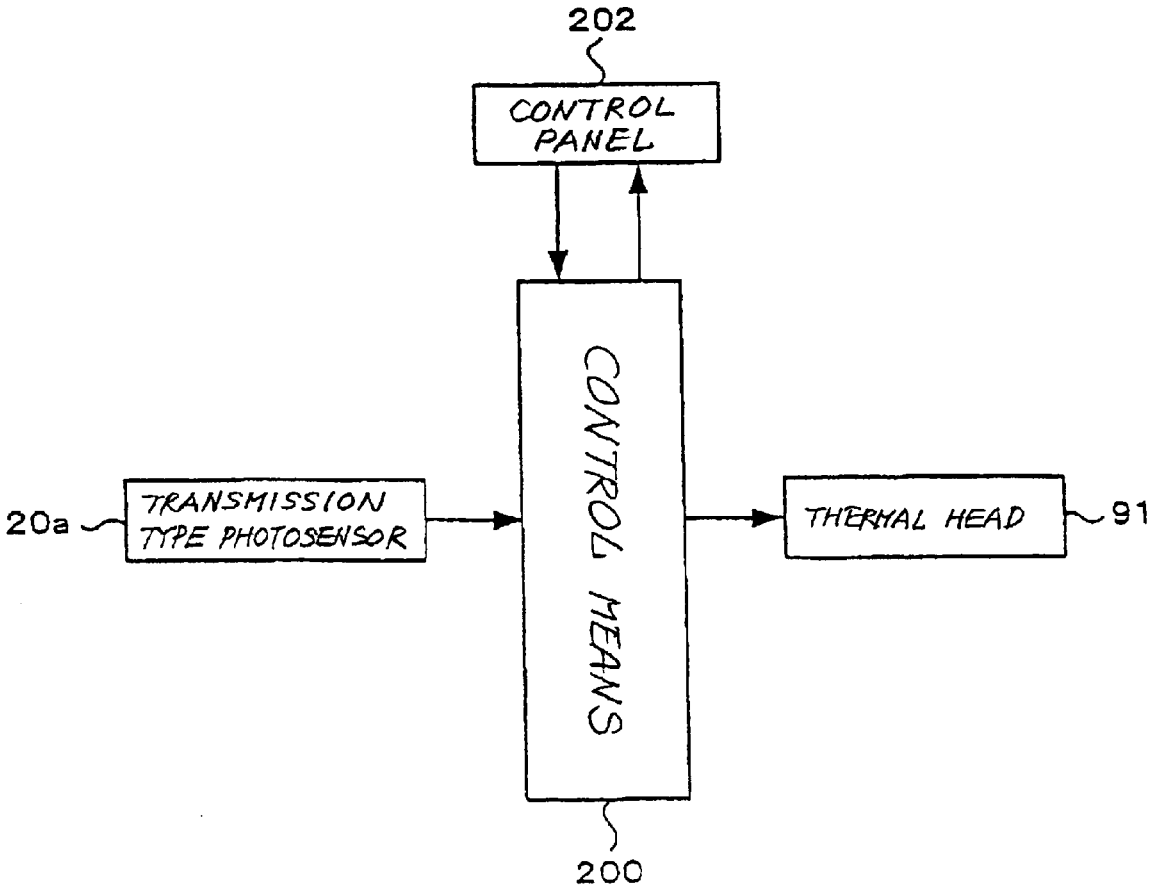
FIG. 3 is a schematic block diagram showing a control system included in the first embodiment.

FIG. 3 shows a specific configuration of a control system included in the illustrative embodiment. As shown, the output of the photosensor 20*a* is input to control means 200, which is a main controller included in the printer. The control means 200 controls the drive of the thermal head 91 in accordance with the output of the photosensor 20*a*. The control means 200 is implemented as a microcomputer including a CPU (Central Processing Unit), a ROM (Read Only Memory), a RAM (Random Access Memory) and an I/O (Input/Output) interface. A control panel 202 is also connected to the control means 200.

Figure 4:
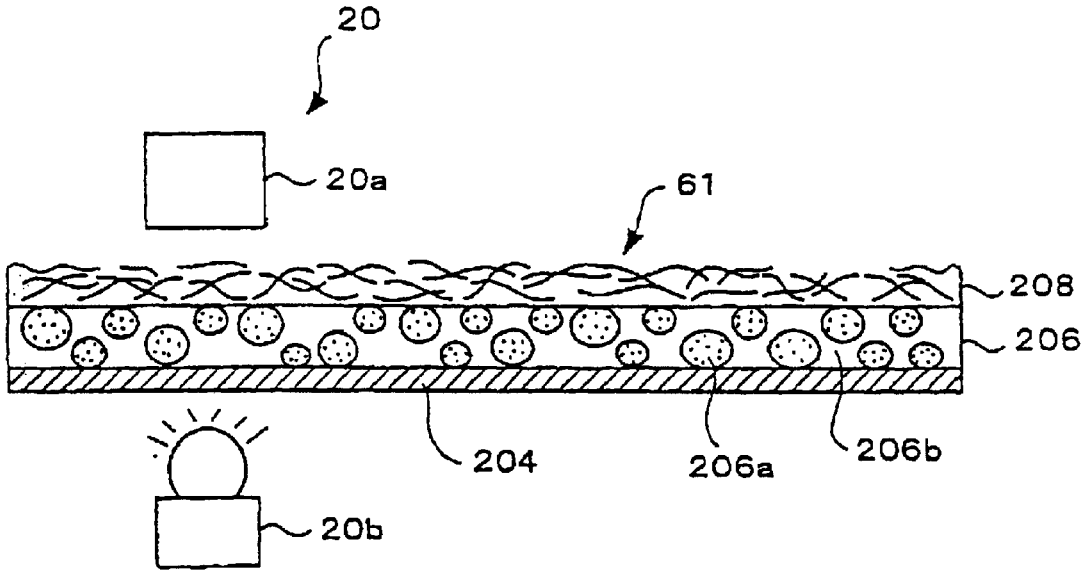
FIG. 4 is a section showing a relation between a thermosensitive stencil and transmission type sensing means included in the illustrative embodiment.

As shown in FIG. 4, the stencil 61 has a laminate structure made up of a thermoplastic resin film 204, a porous resin film 206 implemented by thermoplastic resin, and a porous fiber film 208 implemented by interconnected fibers. The resin film 206 and fiber film 208 are stacked on the resin film 204. The porous resin film 206 consists of elements 206*a* constituting the film and a number of cavities 206*b*. To form the resin film 206, resin dissolved in a solvent are, e.g., precipitated and then solidified. The cavities 206*b* are scattered inside and in the surface of the film 206. Considering the permeation of the ink, it is preferable that the cavities 206*b* be continuous inside the film 206 in the direction of thickness and that, assuming that the resin film 204 is a floor, the cavities 206*b* be through toward the ceiling.

Resin that is the major component of the porous resin film 206 may be selected from any one of polyethylene, polypropylene, polybutene, styrene resin, polyvinyl chloride, polyvinylidene chloride, polyvinyl alcohol, polyvinyl acetate, polyvinyl butyral, polyvinyl acetal, vinyl chloride-vinyl acetate copolymer, vinyl chloride-vinylidene chloride copolymer, vinyl chloride-acrylonitrile copolymer, styrene-acrylonitrile copolymer or similar vinyl resin, polyacrylonitrile, polyacrylic acid plastic, diene plastic, polybutyrene, nylon or similar polyamide, polyester, polyphenylene oxide, (meta)acrylic acid ester, polycarbonate, polyacetal, fluorine-contained resin, polyurethane plastic, natural plastics, natural rubber plastic, thermoplastic elastomers, acetyl cellulose, acetyl butyl cellulose, acetyl propyl cellulose or similar cellulose derivative, bacteria plastic, and a copolymer containing any one of such polymers. Further, use may be made of any one of fatty acids, carbohydrates including waxes, and proteins.

During the production of the porous resin film 206, a filler may be added to a resin solvent, as needed. The filler has influence on the shape, strength and perforation diameter of the porous resin film during drying. The filler may be selected from zinc oxide, titanium dioxide, calcium carbide, silica or similar inorganic compound or polyvinyl acetate, polyvinyl chloride, polymethyl acrylate or similar organic polymer.

Further, the porous resin film 206 may contain an antistaic agent, an antisticking agent, a surfactant, an antiseptic and/or an antifoaming agent within a range that does not obstruct perforation.

As for the thermoplastic resin film 204, use may be made of a vinyl chloride-vinylidene chloride copolymer film, a polypropylene film, polyester film or similar conventional film customary with a thermosensitive stencil.

An antisticking layer may be formed on the film surface in order to prevent it from sticking to the thermal head 91. The antisticking agent may be any one of agents customary with thermosensitive stencils, e.g., a silicone parting agent, a fluorine parting agent or a phosphoric ester surfactant.

The porous fiber film 208 is produced by a conventional procedure. For the porous fiber film 208, use may be made of the fibers of glass, cepiolite, metal or similar mineral, wool, silk or similar animal fibers, cotton, flax or similar plant fibers, staple, rayon or similar regenerated fibers, polyester, polyvinyl alcohol acryl or similar synthetic fibers, carbon fibers or similar semisynthetic fibers or inorganic fibers having a whisker structure. It should be noted that the porous film covers Japanese paper fibers, porous sheets, mesh sheets and so forth.

The porous resin film 206 has fine cavities overlapping each other in a complicated structure in the direction of thickness and has low transmittance. Therefore, even when the porous fiber film 208 is seen from the resin film 206 side, the fiber film 208 is little visible. The transmission type photosensor 20*a* senses only a small quantity of light transmitted through a stencil including the porous resin film 206. It follows that by sensing the level of the quantity of transmitted light, it is possible to distinguish a stencil including the porous resin film 206 and the usual master.

The ROM of the control means 200 stores the sensing level of a quantity of light to be transmitted through the stencil 61 in the direction of thickness, more specifically a preselected range including sensing errors, obtained by experiments by way of example. By using the above sensing level as a reference, the control means 200 identifies the kind of a stencil on the basis of the output of the photosensor 20*a*. If the quantity of light sensed by the photosensor 20*a* small and lies in the preselected range, then the controller 200 determines that the master 61 is a qualified or adequate stencil applicable to the printer, and then allows the printer to start perforating the stencil 61.

However, assume that the quantity of light sensed by the photosensor 20*a* is great and does not lie in the preselected range. Then, the controller 200 determines that the stencil is unqualified or inadequate, and then inhibits a platen roller drive motor, not shown, and the thermal head 91 from being driven (stop of master making) while outputting an alarm. The alarm may be implemented as a message, e.g., "This stencil is not adequate." appearing on the control panel 202. The message urges to the operator to replace the stencil with a qualified stencil, i.e., a stencil including the porous resin film 206.

While the illustrative embodiment stops master making and outputs an alarm, it may alternatively stop master making without outputting an alarm. Further, when an unqualified stencil is set on the printer, the illustrative embodiment may execute master making by varying an energy condition for master making.

Second Embodiment

Figure 5:
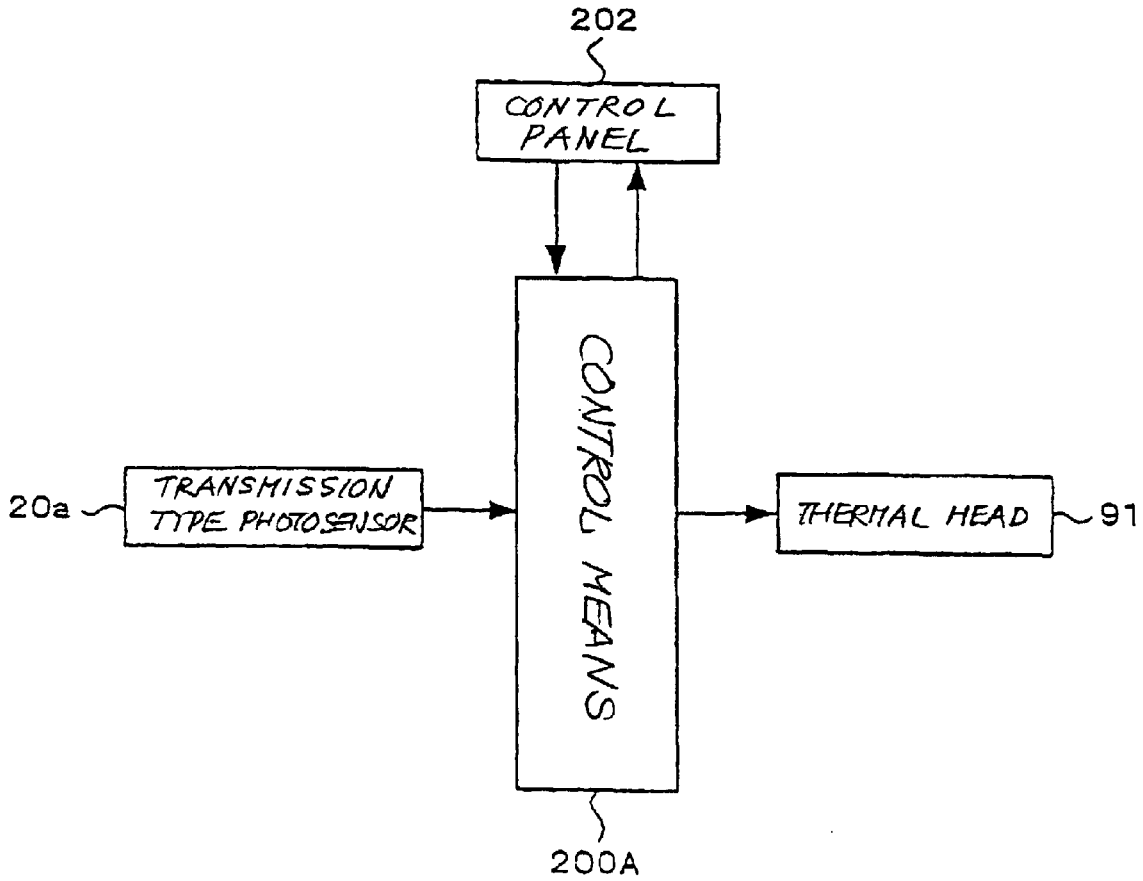
FIG. 5 is a schematic block diagram showing a control system representative of a second embodiment of the present invention.

Reference will be made to FIG. 5 for describing a second embodiment of the stencil printer in accordance with the present invention. Structural elements identical with those of the first embodiment are designated by identical reference numerals and will not be described specifically in order to avoid redundancy.

Even stencils having identical porous resin films are sometimes differ in cavity ratio from each other, depending on the lot, as stated earlier. This results in a difference in ink permeability and thereby makes print quality unstable. More specifically, although the cavities are randomly formed on a production line and therefore the cavity ratio is not constant in the micro sense, irregularity in cavity ratio that effects ink permeability sometimes occurs between lots. The illustrative embodiment insures stable print quality without regard to such irregularity in cavity ratio.

As shown in FIG. 5, the illustrative embodiment includes control means 200A also including a ROM. The ROM stores a data table listing a relation between the quantity of light transmitted through the stencil 61 in the direction of thickness and the optimal master making (perforating) energy. Referencing this data table, the control means 200A selects particular master making energy matching with a quantity of light sensed by the photosensor 20*a* and then applies the master making energy to the thermal head 91.

More specifically, if the cavities are dense and reduces the quantity of light transmitted through the stencil and therefore ink permeability, then the control means 200A increases master making energy to be applied to the thermal head 91, i.e., the perforation diameter to thereby increase the amount of ink to be transferred to the sheet. If otherwise, the control means 200A reduces master making energy, i.e., the perforation diameter to thereby reduce the amount of ink to be transferred to the sheet. The data table lists the quantities of light in a plurality of steps for implementing delicate control over the amount of ink.

Third Embodiment

Figure 6:
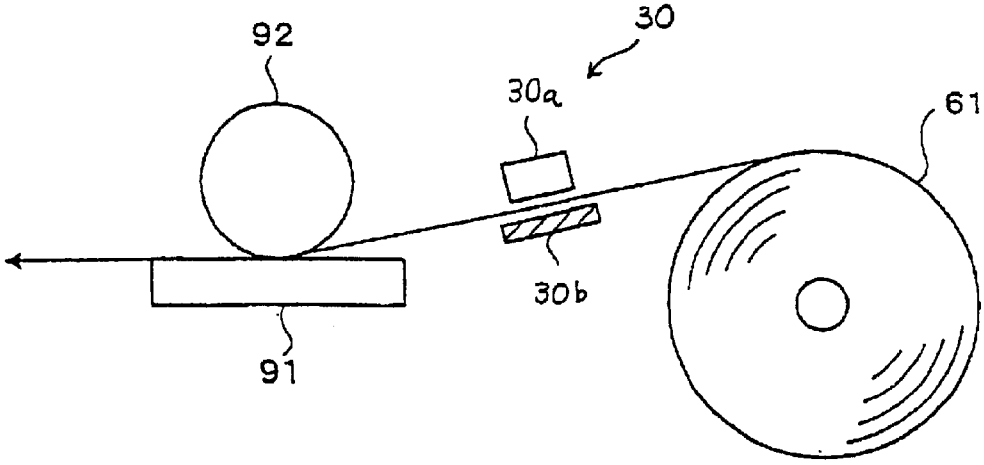
FIG. 6 is an enlarged view showing a master making device representative of a third embodiment of the present invention.
Figure 7:
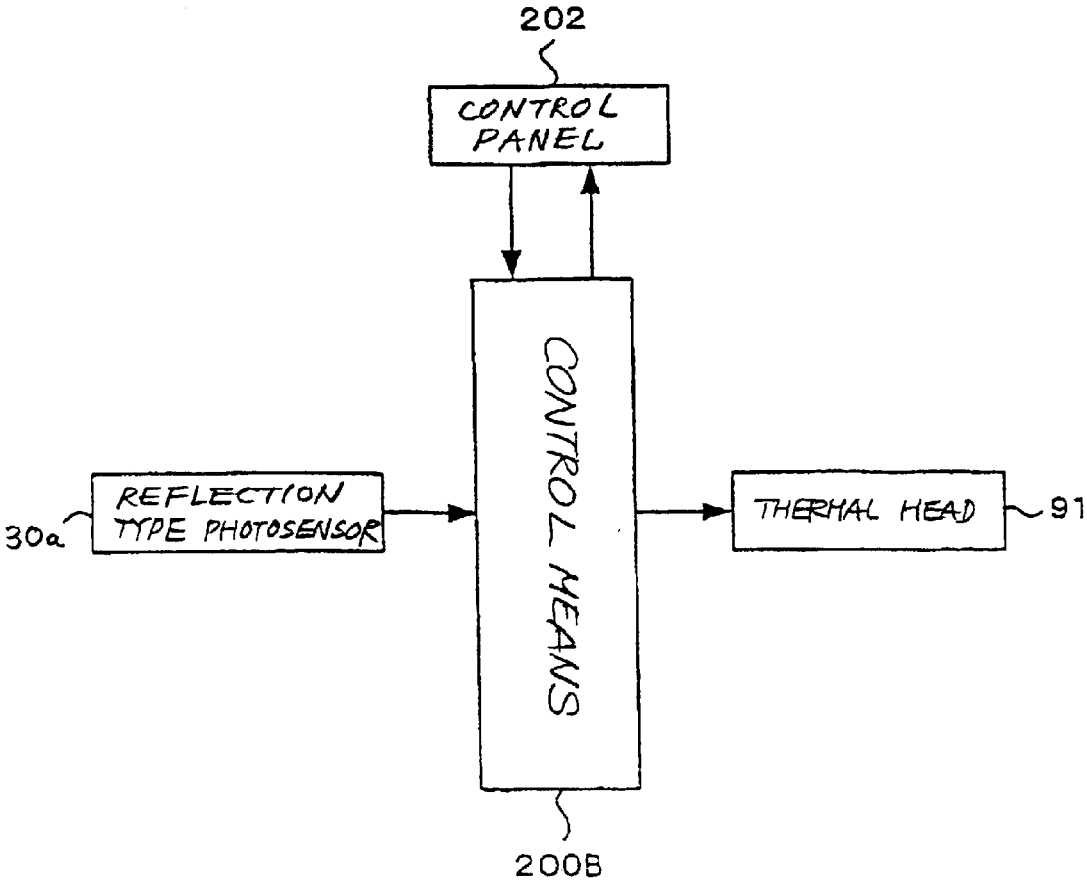
FIG. 7 is a schematic block diagram showing a control system included in the third embodiment.

Referring to FIGS. 6 and 7, a third embodiment of the stencil printer in accordance with the present invention will be described. A stencil including a porous support implemented as a porous resin film has fine cavities overlying each other in the direction of thickness in a complicated structure and therefore transmits light little, as stated previously. It follows that when such a stencil is seen from the film surface side, the other side of the stencil is difficult to see. By using this characteristic of a stencil, the illustrative embodiment determines the condition of cavities.

As shown in FIG. 6, a reflection type photosensor or sensing means 30*a* is positioned at one side of the stencil 61. A black plate 30*b* is positioned at the other side of the stencil in such a manner as to face the photosensor 30*a* and plays the role of a low-reflectance member. The photosensor 30*a* and black plate 30*b* constitute cavity sensing means 30.

If the stencil 61 includes the porous resin film with dense cavities, then light issuing from the photosensor 30*a* is transmitted through the stencil 61 only in a small quantity and therefore little absorbed by the black plate 30*b*. As a result, much of the light is reflected and incident to the photosensor 30*a*. If the density of the cavities is low, then the light issuing from the photosensor 30*a* is transmitted through the stencil 61 in a great quantity, i.e., little reflected.

Control means 200B shown in FIG. 7 includes a ROM storing the sensing level of a quantity of light to be reflected by the stencil 61 in the direction of thickness, more specifically a preselected range including sensing errors, obtained by experiments by way of example. By using the above sensing level as a reference, the control means 200B identifies the kind of a stencil on the basis of the output of the photosensor 30*a*. If the quantity of light sensed by the photosensor 30*a* is great and lies in the preselected range, then the controller 200B determines that the master 61 is a qualified stencil applicable to the printer, and then allows the printer to start perforating the stencil 61.

However, assume that the quantity of light sensed by the photosensor 20*a* is small and does not lie in the preselected range. Then, the controller 200B determines that the stencil is unqualified, and then inhibits a platen roller drive motor, not shown, and the thermal head 91 from being driven (stop of master making) while outputting an alarm. The alarm may be implemented as a message, e.g., "This stencil is not adequate." appearing on the control panel 202. The message urges to the operator to replace the stencil with a qualified stencil, i.e., a stencil including the porous resin film 206.

While the illustrative embodiment stops master making and outputs an alarm, it may alternatively stop master making without outputting an alarm. Further, when an unqualified stencil is set on the printer, the illustrative embodiment may execute master making by varying an energy condition for master making.

Fourth Embodiment

Figure 8:
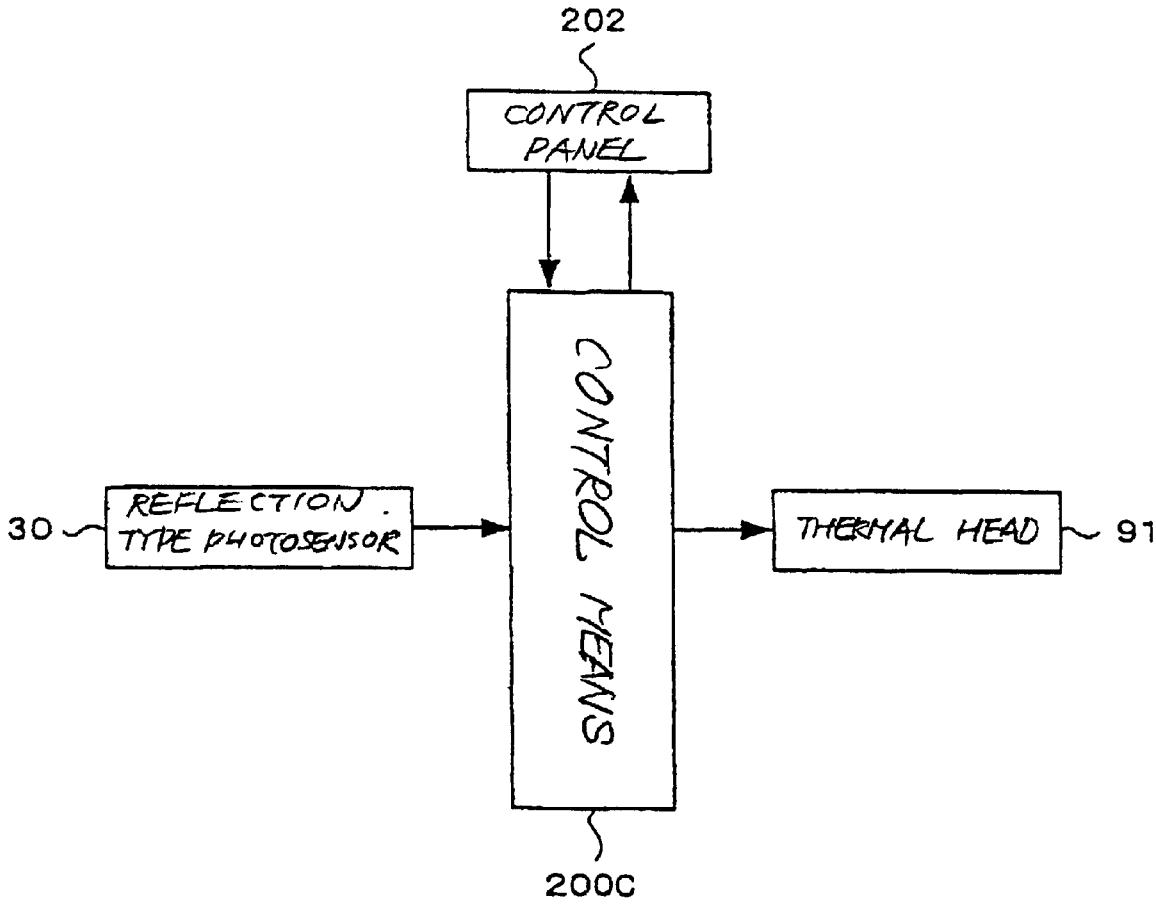
FIG. 8 is a block diagram showing a control system representative of a fourth embodiment of the present invention.

FIG. 8 shows a fourth embodiment of the stencil printer in accordance with the present invention configured to insure stable print quality even when the cavity ratio is different between identical stencils 61. Control means 200C shown in FIG. 8 includes a ROM storing a data table showing a relation between the level of a quantity of reflected light in the direction of thickness of the stencil 61 and the optimal master making energy determined by, e.g., experiments beforehand. Referencing the data table, the control means 200C selects master making energy corresponding to a quantity of reflected light incident to the photosensor 30*a*, FIG. 6, and applies the master making energy selected to the thermal head 91.

More specifically, if the cavities are dense and reflect much of incident light, then the ink permeability of the stencil 61 is low. In this case, the control means 200C increases master making energy and therefore perforation diameter to thereby increase the amount of ink to be transferred to a sheet. If the cavities are not dense enough to reflect much light, then ink permeability is high, so that the control means 200C reduces master making energy and therefore perforation diameter to thereby reduce the amount of ink to be transferred to a sheet. The data table lists the quantities of reflected light in a plurality of steps for implementing delicate control over the amount of ink.

Fifth Embodiment

Figure 9:
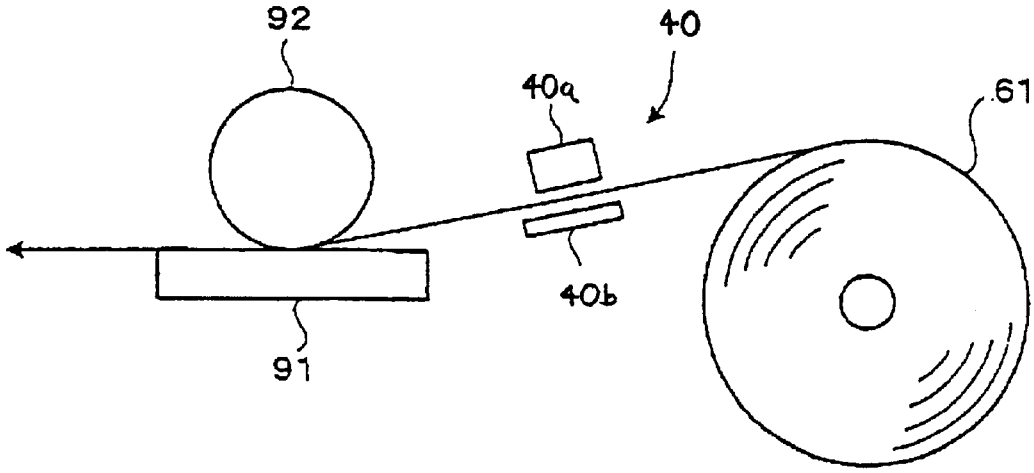
FIG. 9 is a fragmentary view showing a master making device representative of a fifth embodiment of the present invention.

A fifth embodiment of the stencil printer in accordance with the present invention will be described hereinafter with reference to FIGS. 9 and 10. This embodiment, like the third and fourth embodiments, includes cavity sensing means. As shown in FIG. 9, cavity sensing means 40 is made up of a reflection type photosensor or reflection sensing member 40*a* and a reflection plate 40*b*, which plays the role of a reflection member having high reflectance. High reflectance refers to reflectance of such a degree that, when the cavity ratio of the porous support is lower than a preselected level, light issuing from the photosensor 40*a* is transmitted through the stencil 61, reflected by the reflection member 40*b*, and again transmitted through the stencil 61 to reach the photosensor 40*a*.

If the stencil 61 including the porous resin film 206 with a high cavity ratio, then light issuing from the photosensor 40*a* is not transmitted through the stencil 61 in a great amount. In this case, the quantity of light reflected by the reflection member 40*b* and then incident to the photosensor 40*a* via the stencil 61 is small. By contrast, the quantity of such light returned to the photosensor 40*a* is great if the cavity ratio of the porous resin film 206 is low.

Figure 10:
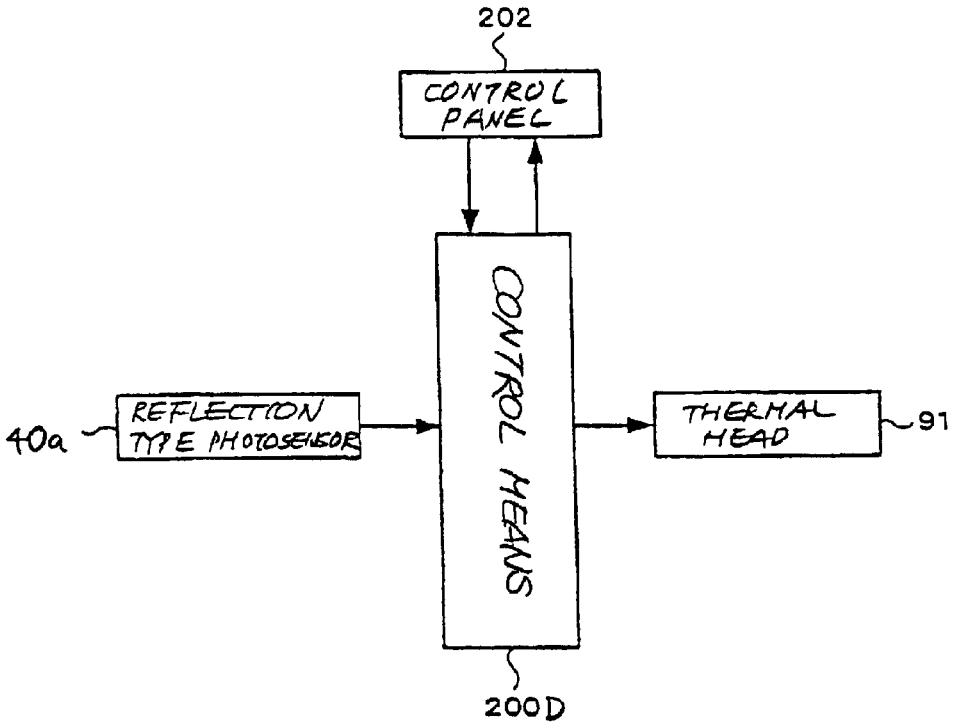
FIG. 10 is a schematic block diagram showing a control system included in the fifth embodiment.

As shown in FIG. 10, the output of the reflection type photosensor 40*a* is sent to control means 200D, which is a main controller included in the stencil printer. The control means 200D controls the drive of the thermal head 91 in accordance with the output of the photosensor 40*a*. Again, the control means 200D is implemented as a microcomputer including a CPU, a ROM, a RAM and an I/O interface.

The control means 200D includes a ROM storing a data table showing the sensing level of a quantity of reflected light in the direction of thickness of the stencil 61 determined by, e.g., experiments beforehand. By using the sensing level as a reference, the control means 200C identifies the kind of the stencil 61 in accordance with the output of the photosensor 40*a*.

More specifically, if the quantity of reflected light sensed by the photosensor 40*a* is small and lies in the preselected range, then the controller 200D determines that the master 61 is a qualified stencil applicable to the printer, and then allows the printer to start perforating the stencil 61. However, assume that the quantity of reflected light sensed by the photosensor 40*a* is great and does not lie in the preselected range. Then, the controller 200D determines that the stencil is unqualified, and then inhibits a platen roller drive motor, not shown, and the thermal head 91 from being driven (stop of master making) while outputting an alarm. The alarm may be implemented as a message, e.g., "This stencil is not adequate." appearing on the control panel 202. The message urges to the operator to replace the stencil with a qualified stencil, i.e., a stencil including the porous resin film 206.

While the illustrative embodiment stops master making and outputs an alarm, it may alternatively stop master making without outputting an alarm. Further, when an unqualified stencil is set on the printer, the illustrative embodiment may execute master making by varying the energy condition for master making. Further, the master 61 is shown as including the porous fiber film 208 stacked on the porous resin film 206. The illustrative embodiment is, of course, practicable even when the porous fiber film 208 is absent.

Sixth Embodiment

Figure 11:
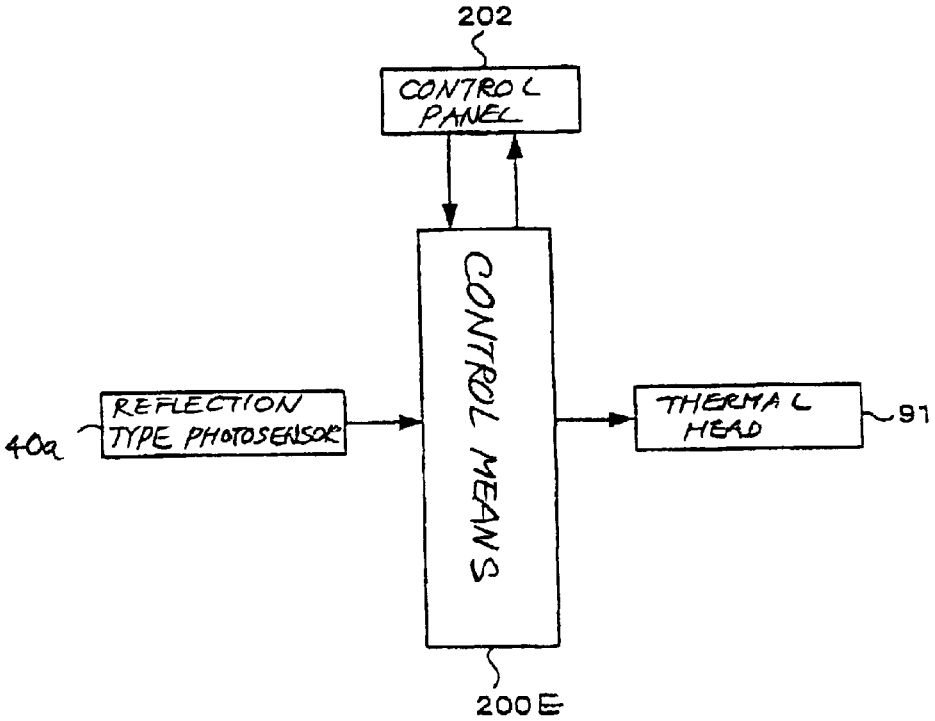
FIG. 11 is a schematic block diagram showing a control system representative of a sixth embodiment of the present invention.

FIG. 11 shows a sixth embodiment of the stencil printer in accordance with the present invention directed to the same object as the fourth embodiment. As shown, control means 200E includes a ROM storing a data table showing a relation between the level of a quantity of reflected light in the direction of thickness of the stencil 61 and the optimal master making energy determined by, e.g., experiments beforehand. Referencing the data table, the control means 200E selects master making energy corresponding to a quantity of reflected light incident to the photosensor 40*a*, FIG. 9, and applies the master making energy selected to the thermal head 91.

More specifically, if the cavities are dense and reflect much of incident light, then the ink permeability of the stencil 61 is low. In this case, the control means 200E increases master making energy and therefore perforation diameter to thereby increase the amount of ink to be transferred to a sheet. If the cavities are not dense enough to reflect much light, then ink permeability is high, so that the control means 200E reduces master making energy and therefore perforation diameter to thereby reduce the amount of ink to be transferred to a sheet. The data table lists the quantities of reflected light in a plurality of steps for implementing delicate control over the amount of ink.

Figure 12:
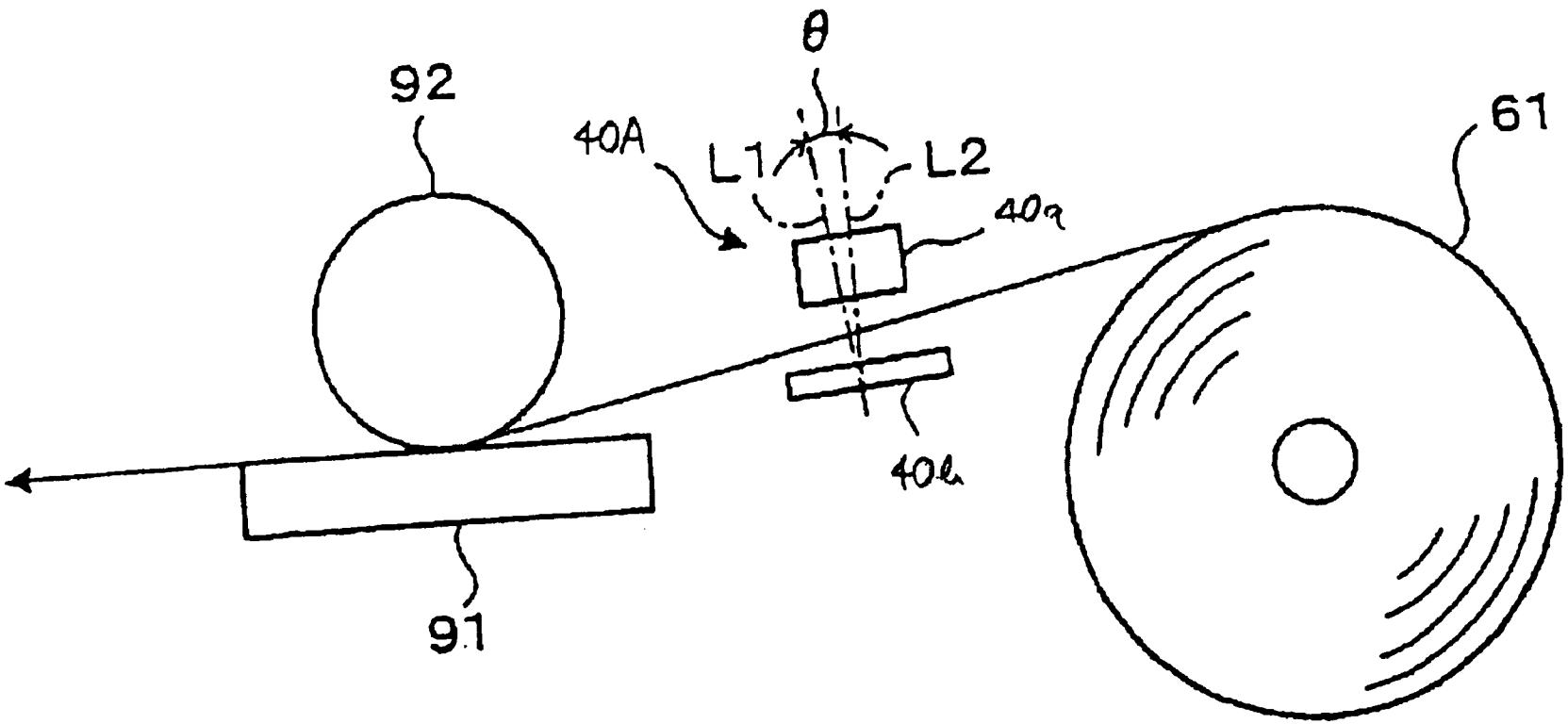
FIG. 12 is a fragmentary view showing a modification of the sixth embodiment.

FIG. 12 shows a modification of the embodiment shown in FIG. 5 or 6. As shown, in the modification, the reflection type photosensor 40*a* and reflection plate 40*b* face each other on a line L2 inclined by a preselected angle θ from a line L1 perpendicular to the surface of the stencil 61. With this configuration, it is possible to exclude light reflected by the surface of the stencil 61 from the output of the photosensor 40*a* for thereby enhancing further accurate detection of the cavity condition of the stencil 61.

If desired, master making energy, which is the master making condition controlled in accordance with the cavity condition of the stencil 61, may be replaced with the duration of heat generation by the individual heat generating element included in the thermal head 91. In such a case, if the cavity ratio is high, then the above duration is increased to increase the perforation diameter of the thermoplastic resin film 204. If the cavity ratio is low, then the duration is reduced to reduce the perforation diameter.

In summary, it will be seen that the present invention provides a stencil printer capable of insuring stable print quality without regard to a difference in cavity ratio between the lots of stencils. Further, the stencil printer can surely, automatically identify the kind of a stencil to thereby obviate troublesome resetting of a stencil and therefore down time and wasteful master making. In addition, the stencil printer can accurately sense the cavity condition of a stencil.

Various modifications will become possible for those skilled in the art after receiving the teachings of the present disclosure without departing from the scope thereof.

What is claimed is:

1. A master making device for a stencil printer, comprising:

master making means for perforating a stencil, which includes a support formed on one of opposite surfaces of a thermoplastic resin film, in accordance with image data;

transmission type sensing means for sensing a transmittance of material forming the stencil in a direction of thickness; and control means configured to determine a condition of cavities existing in the material forming the stencil in accordance with information output from said sensing means and then vary a master making condition in matching relation to said condition.

2. In a stencil printer for making a master with a master making device in accordance with image information and wrapping said master around a print drum to thereby effect printing, said master making device comprising:

master making means for perforating a stencil, which includes a support formed on one of opposite surfaces of a thermoplastic resin film, in accordance with image data;

transmission type sensing means for sensing a transmittance of material forming the stencil in a direction of thickness; and control means configured to determine a condition of cavities existing in the material forming the stencil in accordance with information output from said sensing means and then vary a master making condition in matching relation to said condition.

3. A master making device for a stencil printer, comprising:

master making means for perforating a stencil, which includes a support formed on one of opposite surfaces of a thermoplastic resin film, in accordance with image data;

transmission type sensing means for sensing a transmittance of the stencil in a direction of thickness; and control means configured to determine a condition of cavities existing in the stencil in accordance with information output from said sensing means and inhibit, if said stencil is of an unqualified kind, master making operation.

4. The device as claimed in claim 3, wherein said control means produces an alarm if the stencil is of an unqualified kind.

5. In a stencil printer for making a master with a master making device in accordance with image information and wrapping said master around a print drum to thereby effect printing, said master making device comprising:

master making means for perforating a stencil, which includes a support formed on one of opposite surfaces of a thermoplastic resin film, in accordance with image data;

transmission type sensing means for sensing a transmittance of the stencil in a direction of thickness; and control means configured to determine a condition of cavities existing in the stencil in accordance with information output from said sensing means and inhibit, if said stencil is of an unqualified kind, master making operation.

6. The device as claimed in claim 5, wherein said control means produces an alarm if the stencil is of an unqualified kind.

7. A master making device for a stencil printer, comprising:

master making means for perforating a stencil, which includes a support formed on one of opposite surfaces of a thermoplastic resin film, in accordance with image data;

reflection type sensing means facing one of opposite surfaces of the stencil;

a low-reflectance member facing said reflection type sensing means with the intermediary the stencil; and control means configured to determine a condition of cavities existing in material forming the support of the stencil in accordance with information output from said reflection type sensing means and then vary a master making condition in matching relation to said condition.

8. In a stencil printer for making a master with a master making device in accordance with image information and wrapping said master around a print drum to thereby effect printing, said master making device comprising:

master making means for perforating a stencil, which includes a support formed on one of opposite surfaces of a thermoplastic resin film, in accordance with image data;

reflection type sensing means facing one of opposite surfaces of the stencil;

a low-reflectance member facing said reflection type sensing means with the intermediary the stencil; and control means configured to determine a condition of cavities existing in material forming the support of the stencil in accordance with information output from said reflection type sensing means and then vary a master making condition in matching relation to said condition.

9. A master making device for a stencil printer, comprising:

master making means for perforating a stencil, which includes a support formed on one of opposite surfaces of a thermoplastic resin film, in accordance with image data;

reflection type sensing means facing one of opposite surfaces of the stencil;

a low-reflectance member facing said reflection type sensing means with the intermediary the stencil; and control means configured to identify a kind of the stencil in accordance with information output from said reflection type sensing means and inhibit, if said stencil is not of a qualified kind, master making operation.

10. The device as claimed in claim 9, wherein said control means produces an alarm if the stencil is of an unqualified kind.

11. In a stencil printer for making a master with a master making device in accordance with image information and wrapping said master around a print drum to thereby effect printing, said master making device comprising:

master making means for perforating a stencil, which includes a support formed on one of opposite surfaces of a thermoplastic resin film, in accordance with image data;

reflection type sensing means facing one of opposite surfaces of the stencil;

a low-reflectance member facing said reflection type sensing means with the intermediary the stencil; and control means configured to identify a kind of the stencil in accordance with information output from said reflection type sensing means and inhibit, if said stencil is not of a qualified kind, master making operation.

12. The device as claimed in claim 11, wherein said control means produces an alarm if the stencil is of an unqualified kind.

13. A method of perforating a stencil, which includes a support formed on one of opposite surfaces of a thermoplastic resin film, in accordance with image data to thereby make a master, said method comprising the steps of:

determining a condition of cavities existing in material forming the support of the stencil by sensing a transmittance of said stencil in a direction of thickness; and varying a master making condition in accordance with the condition of cavities determined.

14. A method of perforating a stencil, which includes a support formed on one of opposite surfaces of a thermoplastic resin film, in accordance with image data to thereby make a master, said method comprising the steps of:

determining a condition of cavities existing in material forming the support of the stencil by sensing a reflectance of said stencil; and varying a master making condition in accordance with the condition of cavities determined.

15. A stencil printer including a master making section for perforating a master, which includes a porous support and a thermoplastic resin film, in accordance with image data to thereby make a master, and wrapping said master around a print drum to thereby effect printing, said stencil printer comprising:

cavity sensing means comprising a reflection type sensing member facing one of opposite surfaces of the stencil and a high-reflectance reflection member facing said reflection type sensing member while facing the other surface of said stencil, said cavity sensing means sensing a condition of cavities existing in the porous support; and control means configured to identify a kind of the stencil by determining the condition of the cavities in accordance with information output from said cavity sensing means and inhibit, if the stencil is not of a qualified kind, the master making section from operating.

16. The stencil printer in accordance with claim 15, wherein said control means produces an alarm if the stencil is of an unqualified kind.

17. The stencil printer as claimed in claim 15, wherein said reflection type sensing member and said high-reflectance reflection member face each other at a position inclined by a preselected angle from a position perpendicular to the stencil.

18. A stencil printer including a master making section for perforating a master, which includes a porous support and a thermoplastic resin film, in accordance with image data to thereby make a master, and wrapping said master around a print drum to thereby effect printing, said stencil printer comprising:

cavity sensing means comprising a reflection type sensing member facing one of opposite surfaces of the stencil and a high-reflectance reflection member facing said reflection type sensing member while facing the other surface of said stencil, said cavity sensing means sensing a condition of cavities existing in material forming the porous support; and control means configured to identify a kind of the stencil by determining the condition of the cavities in accordance with information output from said cavity sensing means and vary a master making condition of the master making section in accordance with the kind of said stencil.

19. The stencil printer as claimed in claim 18, wherein said reflection type sensing member and said high-reflectance reflection member face each other at a position inclined by a preselected angle from a position perpendicular to the stencil.

20. A method of perforating a stencil, which includes a porous support and a thermoplastic resin film, in accordance with image data to thereby form a master, said method comprising the steps of:

determining a condition of cavities existing in material forming said porous support by use of a reflection type sensing member and a high-reflectance reflection member; and varying a master making condition in accordance with the condition of cavities determined.

21. The method as claimed in claim 20, wherein the master making condition comprises master making energy.

* * * * *